US007617958B2

(12) United States Patent
Pozzato

(10) Patent No.: US 7,617,958 B2
(45) Date of Patent: Nov. 17, 2009

(54) STAPLER WITH ADAPTER

(75) Inventor: Giorgio Pozzato, Melegnano MI (IT)

(73) Assignee: Romeo Maestri & Figli S.p.A., Cornaredo MI (IT)

( * ) Notice: Subject to any disclaimer, the term of this patent is extended or adjusted under 35 U.S.C. 154(b) by 15 days.

(21) Appl. No.: 10/590,746

(22) PCT Filed: Apr. 20, 2004

(86) PCT No.: PCT/IT2004/000224

§ 371 (c)(1),
(2), (4) Date: Aug. 25, 2006

(87) PCT Pub. No.: WO2005/102613

PCT Pub. Date: Nov. 3, 2005

(65) Prior Publication Data

US 2007/0199969 A1 Aug. 30, 2007

(51) Int. Cl.
*B25C 5/10* (2006.01)
*B25C 5/00* (2006.01)

(52) U.S. Cl. ..... 227/109; 227/107

(58) Field of Classification Search ..... 227/107, 227/109, 140

See application file for complete search history.

(56) References Cited

U.S. PATENT DOCUMENTS 2,716,749 A * 9/1955 Timmerbeil ..... 227/109
3,510,043 A * 5/1970 Larson ..... 227/113
3,633,811 A * 1/1972 Ploen ..... 227/109
3,958,738 A * 5/1976 Tremblay ..... 227/109
4,304,349 A * 12/1981 Novak et al. ..... 227/109
4,556,161 A 12/1985 Oide
4,598,852 A * 7/1986 Olesen ..... 227/119
4,693,407 A * 9/1987 Buck et al. ..... 227/109
4,706,866 A * 11/1987 Ebihara ..... 227/120
5,337,945 A * 8/1994 Fehrle et al. ..... 227/109
5,497,931 A * 3/1996 Nakamura ..... 227/109
5,516,024 A * 5/1996 Hohner et al. ..... 227/89
5,639,007 A * 6/1997 Nakamura ..... 227/109
5,725,141 A 3/1998 Chi
5,794,832 A * 8/1998 Chen ..... 227/109
6,076,720 A 6/2000 Deng (Continued)

FOREIGN PATENT DOCUMENTS

DE 295 04 339 U 1 6/1995

(Continued)

*Primary Examiner*—Rinaldi I. Rada
*Assistant Examiner*—Gloria R. Weeks
(74) *Attorney, Agent, or Firm*—Lucas & Mercanti, LLP

(57) ABSTRACT

Stapler comprising a main body (1) which includes a seat (2) for a row of staples (3, 13) and/or nails (12, 14) which are urged by a pusher (4) towards an ejection head (5), wherein a striker (6) can run in a direction substantially perpendicular to the feed direction of the row of staples (3, 13) and/or nails (12, 14) in the seat (2) for pushing and ejecting from the ejection head (5) the first staple (3, 13) and/or nail (12, 14) of the row, wherein a mobile plate (7) is mechanically connected to a slider (8) which protrudes outside the main body (1) so that by moving the slider (8) the mobile plate (7) can slide in the main body (1) for being arranged between the ejection head (5) and the striker (6) when the latter pushes the first staple (3, 13) and/or nail (12, 14).

17 Claims, 3 Drawing Sheets

U.S. PATENT DOCUMENTS 6,082,604 A * 7/2000 Dennis ..... 227/8
6,318,617 B1 * 11/2001 Cheng ..... 227/109
6,360,933 B1 * 3/2002 Richardot et al. ..... 227/109
6,695,197 B2 * 2/2004 Johansson ..... 227/138
7,032,795 B2 * 4/2006 Adams et al. ..... 227/82
7,438,206 B2 * 10/2008 Kumayama ..... 227/127
2003/0121949 A1 * 7/2003 Johansson ..... 227/138
2006/0191971 A1 * 8/2006 Li ..... 227/107

FOREIGN PATENT DOCUMENTS

DE 298 03 585 U 1 3/1998

* cited by examiner

STAPLER WITH ADAPTER

This patent application claims the benefit from PCT application Ser. No. PCT/IT2004/000224 filed Apr. 20, 2004, the contents of which are incorporated herein by reference.

The present invention relates to a stapler with adapter, and in particular to a stapler which allows to adapt the ejection chamber of a stapler to the size and the shape of the staples and/or nails to be ejected.

EP-A-911120 discloses a stapler comprising a main body which includes a seat for a row of staples which are urged by a pusher toward an ejection head, in which a striker can run for pushing and ejecting from the ejection head the first staple of the row. Said stapler is provided with an adapter which can shift laterally in said seat for adapting the stapler to the width of the staples to be ejected.

However, said adapter does not allow to adapt the stapler also to the thickness, i.e. the depth, of the staples to be ejected, as well as to the use of nails with or without a head instead of the staples.

It is therefore an object of the present invention to provide a stapler which is free from said disadvantages, i.e. a staple which can be adapted to staples and/or nails having a variable size and shape. Said object is achieved with a stapler, the main features of which are disclosed in the first claim and other features are disclosed in the subsequent claims.

Thanks to its particular mobile plate, the stapler according to the present invention allows to employ staples and/or nails having a variable thickness. Furthermore, said mobile plate is preferably provided with a lateral notch with allows also the use of nails without head, which are contained laterally by the mobile plate for being correctly guided during their ejection.

According to a particular aspect of the invention, the mobile plate can run in a direction substantially parallel to the run direction of the striker and is connected to a slider arranged in the front portion of the main body of the stapler, so as to simplify its manufacture, working and use. Said slider preferably comprises a particular locking mechanism which prevents the accidental sliding of the mobile plate.

Furthermore, the striker and the mobile plate have particular sizes suitably studied for adapting the stapler according to the present invention to the majority of the staples and the nails available in the market.

Further advantages and features of the stapler according to the present invention will become clear to those skilled in the art from the following detailed and non-limiting description of two embodiments thereof with reference to the attached drawings, wherein.

Figure 1:
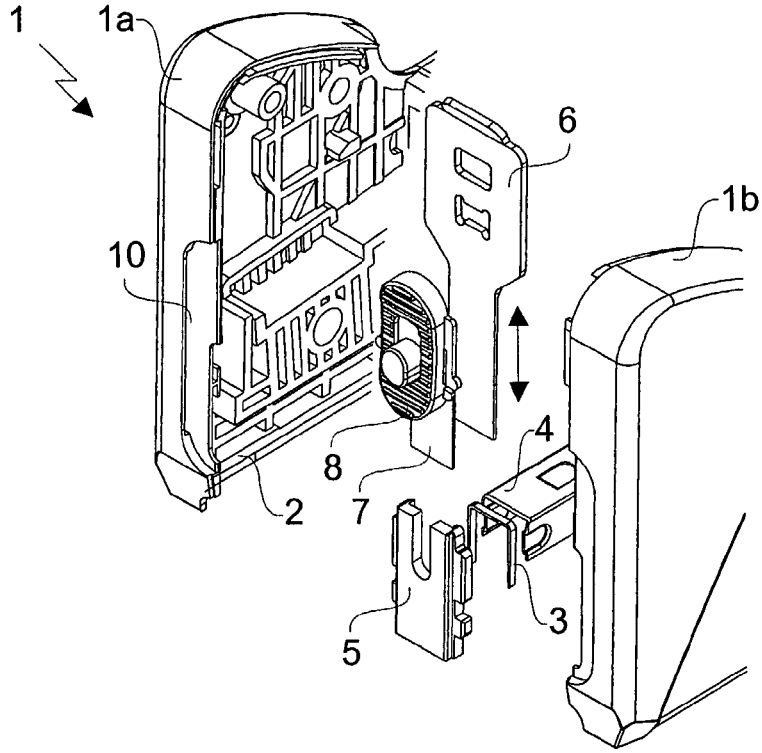
FIG. 1 shows an exploded partial view of a stapler according to the first embodiment of the invention.
Figure 2:
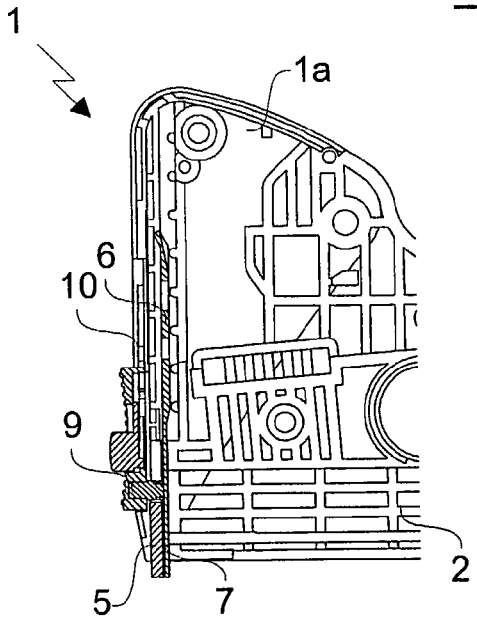
FIG. 2 shows a partial sectioned lateral view of the stapler of FIG. 1.
Figure 3:
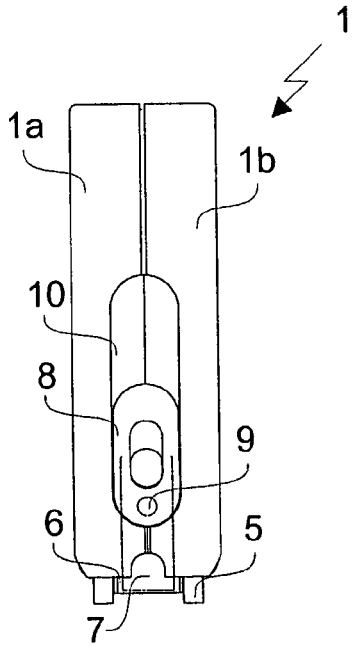
FIG. 3 shows a front view of the stapler of FIG. 1.

Referring to FIGS. 1 to 3, it is seen that the stapler according to the first embodiment of the invention comprises in a known way a main body 1 which includes a seat 2 for a row of metal staples 3 which are urged by a pusher 4 toward an ejection head 5. A striker 6 connected to a mechanic and/or electric driving mechanism (not shown in the figures) can run in a vertical direction (indicated with an arrow in FIG. 1) substantially perpendicular to the feed direction of the row of metal staples 3 in seat 2 for pushing downwards and ejecting from the ejection head 5 the first metal staple 3 of the row.

According to the invention, a mobile plate 7 is mechanically connected to a slider 8 which protrudes outside the main body 1 so that by moving downwards slider 8 the mobile plate 7 can slide in the main body 1 in a direction substantially parallel to the run direction of striker 6 for being arranged (as illustrated in FIGS. 2 and 3) between the ejection head 5 and the striker 6 when the latter pushes the metal staple 3 arranged in the ejection head 5. Therefore, when the mobile plate 7 is lowered, the first metal staples 3 hits against the mobile plate 7 instead of the front wall of the ejection head 5. In the present embodiment, the mobile plate 7 is mechanically connected to slider 8 by means of a pin 9 (indicated with a broken line in FIG. 3) housed in corresponding holes made in the mobile plate 7 and in slider 8.

The main body 1 preferably comprises two half-bodies 1*a*, 1*b* which are mutually joined along a substantially vertical symmetry plane which crosses striker 6 and seat 2. Slider 8 can slide in a guide 10 made in the front wall of half-bodies 1*a*, 1*b*, so that pin 9 crosses an opening formed of two opposing notches made in the two half-bodies 1*a*, 1*b*.

Figure 4:
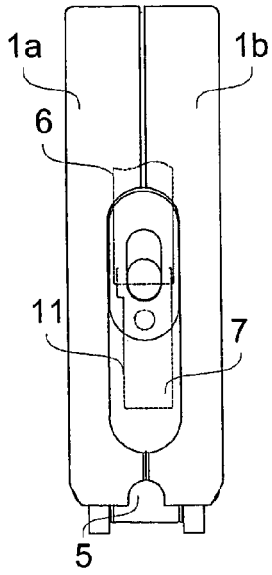
FIG. 4 shows a first front view of a stapler according to the second embodiment of the invention.
Figure 5:
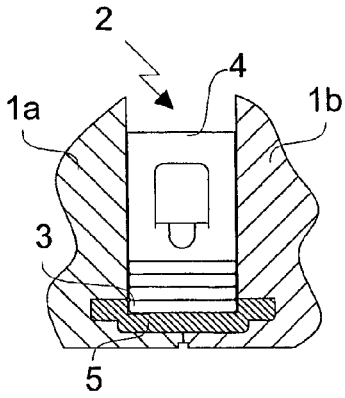
FIG. 5 shows a first partial sectioned top view of the stapler of FIG. 4.
Figure 6:
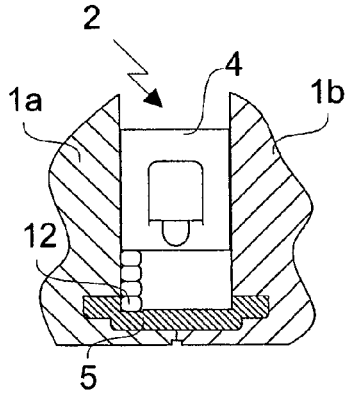
FIG. 6 shows a second partial sectioned top view of the stapler of FIG. 4.
Figure 7:
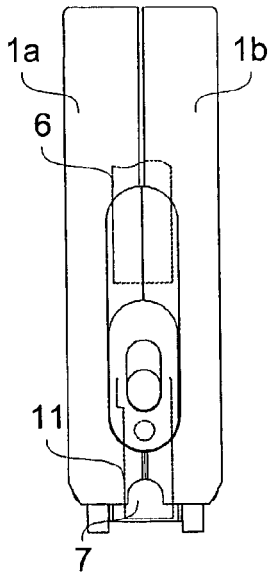
FIG. 7 shows a second front view of the stapler of FIG. 4.
Figure 8:
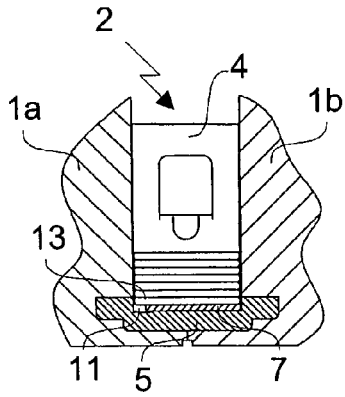
FIG. 8 shows a third partial sectioned top view of the stapler of FIG. 4.
Figure 9:
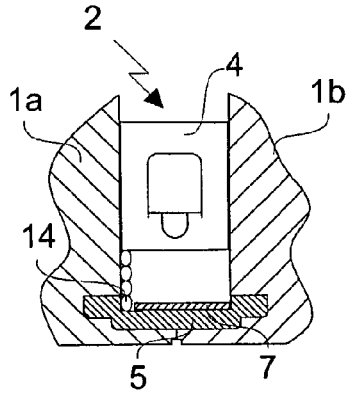
FIG. 9 shows a fourth partial sectioned top view of the stapler of FIG. 4.
Figure 10:
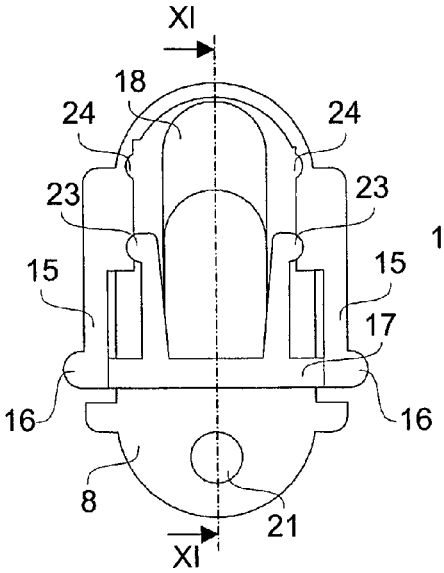
FIG. 10 shows a first rear view of the slider of the stapler according to the present invention.
Figure 11:
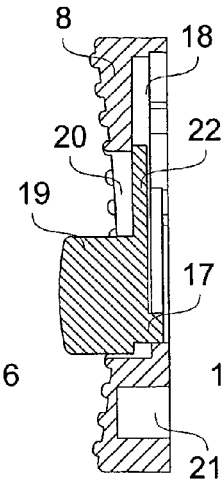
FIG. 11 shows a view sectioned along plane XI-XI of the slider of FIG. 10.
Figure 12:
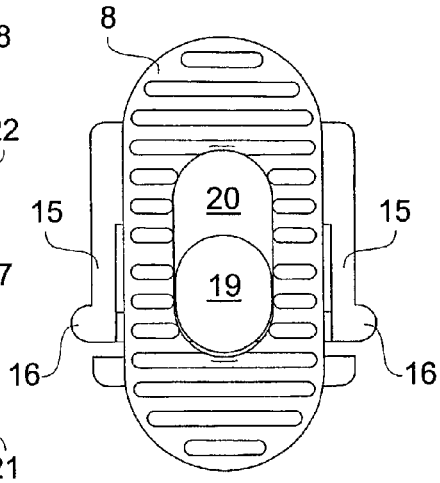
FIG. 12 shows a first front view of the slider of FIG. 10.
Figure 13:
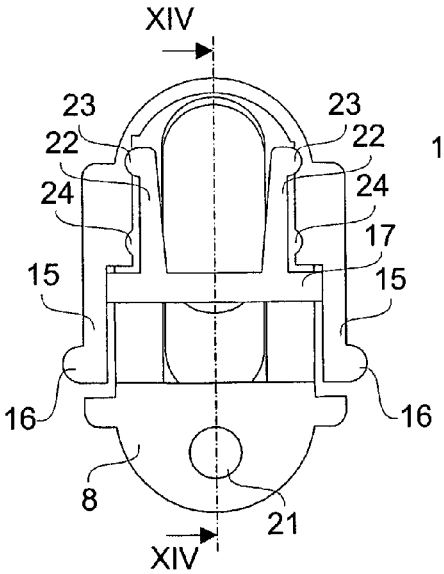
FIG. 13 shows a second rear view of the slider of FIG. 10.
Figure 14:
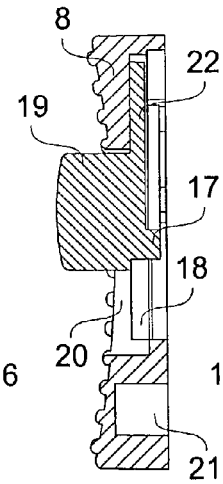
FIG. 14 shows a view sectioned along plane XIV-XIV of the slider of FIG. 10.
Figure 15:
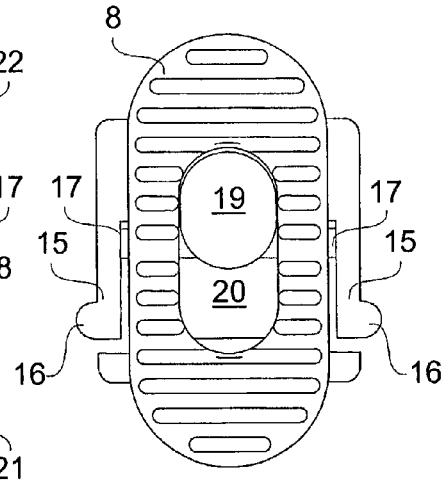
FIG. 15 shows a second front view of the slider of FIG. 10.

Referring to FIGS. 4 to 9, it is seen that in a second embodiment of the invention, the mobile plate 7 is preferably shaped to obtain a notch 11 along at least one side edge thereof, so that the width of the mobile plate 7 is smaller than the seat for the metal staple 3 in the ejection head 5. FIGS. 4 to 6 show the mobile plate 7 lifted for employing metal staples 3 having a normal thickness or nails with head 12. FIGS. 7 to 9 show instead the mobile plate 7 lowered for employing metal staples 13 having a reduced thickness or nails without head 14. As it is clearly shown in FIG. 9, the nails without head 14 are located inside notch 11 and thus are laterally contained by the mobile plate 7.

Referring to FIGS. 10 to 15, it is seen that slider 8 comprises a particular locking mechanism which includes two flexible arms 15 which are made in a single piece, for example of plastic, with the body of slider 8 and are provided with teeth 16 protruding from the sides of the same slider. An expander 17 can slide in a guide 18 made in the central body of slider 8 in a vertical direction equal to the sliding direction of slider 8 in guide 10 of the main body 1, so that expander 17, during its sliding from a position to the other in guide 18, expands outwards the flexible arms 15. Guide 10 of the main body 1 is provided with side cavities (not visible in the figures), in which teeth 16 of the flexible arms 15 can hook, so that when the latter are expanded outwards by expander 17, slider 8 cannot slide in the same guide 10. Expander 17 is provided with a pin 19 crossing an opening 20 made in the middle of slider 8, so that it can be moved by a user with respect to slider 8. Hole 21 for pin 9 which mechanically connects slider 8 to the mobile plate 7 is made in the rear wall of slider 8. Two flexible arms 22 which are made in a single piece, for example of plastic, with the body of expander 17 are provided with teeth 23 protruding from the sides of the same expander for penetrating into corresponding cavities 24 made at the sides of guide 18 of slider 8, so that expander 17 can be partially locked in its extreme lower and/or upper positions. FIGS. 10 to 12 and 13 to 15 show slider 8 with the flexible arms 15 in a retracted and expanded position.

The thickness of striker 6 is preferably lower than 0.8 mm, while its width is comprised between 10 and 12 mm. The thickness of the mobile plate 7 is preferably lower than 0.5 mm, while its width is comprised between 9 and 12 mm. With these sizes, it is possible to employ metal staples 3, 13 having a thickness comprised between 0.7 and 1.3 mm, or nails 12, 14 having a width comprised between 0.9 and 2.1 mm.

Obviously, the above described adjusting mechanism can be applied to the staplers with the anvil for clinching the metal staples, as well as to the staplers lacking in this member, which are also known with the name tacker.

Further modifications and/or additions may be made by those skilled in the art to the hereinabove described and illustrated embodiments of the invention, while remaining within the scope of the same invention.

The invention claimed is:

1. Stapler comprising a main body (1) which includes a seat (2) for a row of staples (3, 13) and/or nails (12, 14) which are urged by a pusher (4) toward an ejection head (5), wherein a striker (6) can run in a direction substantially perpendicular to the feed direction of the row of staples (3, 13) or nails (12, 14) in the seat (2) for pushing and ejecting from the ejection head (5) the first staple (3, 13) or nail (12, 14) of the row, a mobile plate (7) being mechanically connected to a slider (8) which protrudes outside the main body (1), characterized in that by moving the slider (8) the mobile plate (7) can slide in the main body (1) from a rest position to an operative position for being arranged between the ejection head (5) and the striker (6) when the latter pushes the first staple (3, 13) or nail (12, 14), wherein the mobile plate (7) can slide in a direction substantially perpendicular to the feed direction of the row of staples (3, 13) or nails (12, 13), and wherein the mobile plate 7 can slide in a direction substantially parallel to the run direction of the striker 6.

2. Stapler according to claim 1, characterized in that the mobile plate (7) is mechanically connected to the slider (8) by means of a pin (9) housed in corresponding holes (21) made in the mobile plate (7) and in the slider (8).

3. Stapler according to claim 2, characterized in that the main body (1) comprises two half-bodies (1*a*, 1*b*), and wherein the pin (9) connecting the mobile plate (7) to the slider (8) crosses an opening formed of two opposing notches made in the two half-bodies (1*a*, 1*b*) of the main body (1).

4. Stapler according to claim 1, characterized in that the main body (1) comprises two half-bodies (1*a*, 1*b*) which are mutually joined along a substantially vertical symmetry plane which crosses the striker (6) and the seat (2) for the staples (3, 13) or nails (12, 14), wherein the slider (8) can slide in a guide (10) made in the front wall of the half-bodies (1*a*, 1*b*).

5. Stapler according to claim 4, characterized in that the mobile plate (7) is mechanically connected to the slider (8) by means of a pin (9) housed in corresponding holes (21) made in the mobile place (7) and in the slider (8) wherein the pin (9) connecting the mobile place (7) to the slider (8) crosses an opening formed of two opposing notches made in the two half-bodies (1*a*, 1*b*) of the main body (1).

6. Stapler according to claim 1, characterized in that the mobile plate (7) has a notch (11) along at least one side edge thereof, so that the width of the mobile plate (7) is smaller than the seat for the staples (3, 13) or nails (12, 14) in the ejection head (5).

7. Stapler according to claim 1, characterized in that the slider (8) comprises a locking mechanism which includes two flexible arms (15) which are made in a single piece with the body of the slider (8) and are provided with teeth (16) protruding from the sides of the same slider, as well as an expander (17) which can slide in a guide (18) made in the central body of the slider (8) in a vertical direction equal to the sliding direction of the slider (8) in the main body (1), so that the expander (17), during its sliding in the guide (18) of the slider (8), expands outwards the flexible arms (15).

8. Stapler according to claim 7, characterized in that the slider (8) can slide in a guide (10) of the main body (1), which guide (10) is provided with side cavities, in which the teeth (16) of the flexible arms (15) can hook, so that when the latter are expanded outwards by the expander (17), the slider (8) cannot slide in the same guide (10).

9. Stapler according to claim 8, characterized in tat the expander (17) is provided with a pin (19) crossing an opening (20) made in the middle of the slider (8), so that this pin (19) can be moved with respect to the slider (8).

10. Stapler according to claim 8, characterized in that two flexible arms (22) which are made in a single piece wit the body of the expander (17) are provided with teeth (23) protruding from the sides of the same expander (17) for penetrating into corresponding cavities (24) made at the sides of the guide (18) of the slider (8), so that the expander (17) can be partially locked in its extreme lower and/or upper positions.

11. Stapler according to claim 7, characterized in that the expander (17) is provided with a pin (19) crossing an opening (20) made in the middle of the slider (8), so that this pin (19) can be moved with respect to the slider (8).

12. Stapler according to claim 11, characterized in that two flexible arms (22) which are made in a single piece with the body of the expander (17) are provided with teeth (23) protruding from the sides of the same expander (17) for penetrating into corresponding cavities (24) made at the sides of the guide (18) of the slider (8), so that the expander (17) can be partially locked in its extreme lower and/or upper positions.

13. Stapler according to claim 7, characterized in that two flexible arms (22) which are made in a single piece with the body of the expander (17) are provided with teeth (23) protruding from the sides of the same expander (17) for penetrating into corresponding cavities (24) made at the sides of the guide (18) of the slider (8), so that the expander (17) can be partially locked in its extreme lower and/or upper positions.

14. Stapler according to claim 1, characterized in that the thickness of the striker (6) is lower than 0.8 mm, while its width is comprised between 10 and 12 mm.

15. Stapler according to claim 1, characterized in that the thickness of the mobile plate (7) is lower than 0.5 mm, while its width is comprised between 9 and 12 mm.

16. Stapler comprising a main body (1) which includes a seat (2) for a row of staples (3, 13) and/or nails (12, 14) which are urged by a pusher (4) toward an ejection head (5), wherein a striker (6) can run in a direction substantially perpendicular to the feed direction of the row of staples (3, 13) or nails (12, 14) in the seat (2) for pushing and ejecting from the ejection head (5) the first staple (3, 13) or nail (12, 14) of the row, a mobile plate (7) being mechanically connected to a slider (8) which protrudes outside the main body (1), characterized in that by moving the slider (8) the mobile plate (7) can slide in the main body (1) from a rest position to an operative position for being arranged between the ejection head (5) and the striker (6) when the latter pushes the first staple (3, 13) or nail (12, 14), further characterized in that the slider (8) comprises a locking mechanism which includes two flexible arms (15) which are made in a single piece with the body of the slider (8) and are provided with teeth (16) protruding from the sides of the same slider, as well as an expander (17) which can slide in a guide (18) made in the central body of the slider (8) in a vertical direction equal to the sliding direction of the slider (8) in the main body (1), so that the expander (17), during its sliding in the guide (18) of the slider (8), expands outwards the flexible arms (15), further characterized in that the guide (10) of the main body (1) is provided with side cavities, in which the teeth (16) of the flexible arms (15) can hook, so that when the latter are expanded outwards by the expander (17), the slider (8) cannot slide in the same guide (10), further characterized in that two flexible arms (22) which are made in a single piece with the body of the expander (17) are provided with teeth (23) protruding from the sides of the same expander (17) for penetrating into corresponding cavities (24) made at the sides of the guide (18) of the slider (8), so that the expander (17)can be partially locked in its extreme lower and/or upper positions.

17. Stapler comprising a main body (1) which includes a seat (2) for a row of staples (3, 13) and/or nails (12, 14) which are urged by a pusher (4) toward an ejection head (5), wherein a striker (6) can run in a direction substantially perpendicular to the feed direction of the row of staples (3, 13) or nails (12, 14) in the seat (2) for pushing and ejecting from the ejection head (5) the first staple (3, 13) or nail (12, 14) of the row, a mobile plate (7) being mechanically connected to a slider (8) which protrudes outside the main body (1), characterized in that by moving the slider (8) the mobile plate (7) can slide in the main body (1) from a rest position to an operative position for being arranged between the ejection head (5) and the striker (6) when the latter pushes the first staple (3, 13) or nail (12, 14), further characterized in that the slider (8) comprises a locking mechanism which includes two flexible arms (15) which are made in a single piece with the body of the slider (8) and are provided with teeth (16) protruding from the sides of the same slider, as well as an expander (17) which can slide in a guide (18) made in the central body of the slider (8) in a vertical direction equal to the sliding direction of the slider (8) in the main body (1), so that the expander (17), during its sliding in the guide (18) of the slider (8), expands outwards the flexible arms (15), further characterized in that the expander (17) is provided with a pin (19) crossing an opening (20) made in the middle of the slider (8), so that this pin (19) can be moved with respect to the slider (8), and further characterized in that two flexible arms (22) which are made in a single piece with the body of the expander (17) are provided with teeth (23) protruding from the sides of the same expander (17) for penetrating into corresponding cavities (24) made at the sides of the guide (18) of the slider (8), so that the expander (17) can be partially locked in its extreme lower and/or upper positions.

* * * * *